United States Patent [19]

Kishi

[11] Patent Number: 4,463,730

[45] Date of Patent: Aug. 7, 1984

[54] FUEL SUPPLY CONTROL METHOD FOR CONTROLLING FUEL INJECTION INTO AN INTERNAL COMBUSTION ENGINE IN STARTING CONDITION AND ACCELERATING CONDITION

[75] Inventor: Noriyuki Kishi, Tokyo, Japan

[73] Assignee: Honda Motor Co., Ltd., Tokyo, Japan

[21] Appl. No.: 503,676

[22] Filed: Jun. 13, 1983

[30] Foreign Application Priority Data

Jun. 16, 1982 [JP] Japan ..... 57-103407

[51] Int. Cl.[3] ..... F02D 5/00

[52] U.S. Cl. ..... 123/491; 123/492; 364/431.07

[58] Field of Search ..... 123/491, 492, 480, 478, 123/486, 493; 364/431, 442

[56] References Cited

U.S. PATENT DOCUMENTS

| | | | |
|---|---|---|---|
| 4,246,639 | 6/1981 | Carp et al. | 123/491 |
| 4,250,849 | 2/1981 | Takase | 123/491 |
| 4,310,888 | 6/1982 | Furubashi et al. | 123/491 |
| 4,312,018 | 1/1982 | Ionai et al. | 123/491 |
| 4,326,488 | 4/1982 | Herth et al. | 123/491 |
| 4,363,307 | 12/1982 | Amaoro et al. | 123/491 |

FOREIGN PATENT DOCUMENTS 2037458 7/1980 United Kingdom ..... 123/491

*Primary Examiner*—Raymond A. Nelli
*Attorney, Agent, or Firm*—Arthur L. Lessler

[57] ABSTRACT

A method for controlling the fuel injection into an internal combustion engine when it is in a starting condition or in an accelerating condition. When a predetermined control parameter shows a value requiring acceleration of the engine, fuel injections are consecutively effected a predetermined number of times in synchronism with generation of pulses of a control signal having a predetermined constant pulse repetition period and being asynchronous with rotation of the engine, immediately after either generation of a pulse of an engine position signal indicative of a predetermined crank angle of the engine or closing of the ignition switch of the engine has been detected. After completion of the above consecutive fuel injections, fuel injection is suspended until a subsequent pulse of the above engine position signal is generated for the first time after the completion of the consecutive fuel injections. Preferably, the value of the above predetermined number of times of consecutive fuel injections is set in dependence on the temperature of the engine, and the injection quantity of fuel per one time is set in dependence on the value of the above predetermined control parameter, preferably, rate of change of the throttle valve opening.

13 Claims, 12 Drawing Figures

FUEL SUPPLY CONTROL METHOD FOR CONTROLLING FUEL INJECTION INTO AN INTERNAL COMBUSTION ENGINE IN STARTING CONDITION AND ACCELERATING CONDITION

BACKGROUND OF THE INVENTION

This invention relates to a fuel supply control method for electronically controlling the quantity of fuel being injected into an internal combustion engine, and more particularly to a fuel supply control method of this kind, which is adapted to control to desired values the quantity of fuel being injected into the engine in synchronism with a control signal having a certain constant pulse repetition period and generated independently of rotation of the engine, so as to improve the startability of the engine as well as the driveability at acceleration.

A fuel supply control system adapted for use with an internal combustion engine, particularly a gasoline engine has been proposed e.g. by Japanese Patent Provisional Publication (Kokai) No. 57-137633, which is adapted to determine the valve opening period of a fuel injection device for control of the fuel injection quantity, i.e. the air/fuel ratio of an air/fuel mixture being supplied to the engine, by first determining a basic value of the valve opening period as a function of engine rpm and intake pipe absolute pressure and then adding to and/or multiplying same by constants and/or coefficients being functions of engine rpm, intake pipe absolute pressure, engine cooling water temperature, throttle valve opening, exhaust gas ingredient concentration (oxygen concentration), etc., by electronic computing means.

According to this proposed fuel supply control system, the calculations of the valve opening period, i.e. fuel injection quantity and the operation of the fuel injection device are executed in synchronism with a top-dead-center (TDC) signal which is generated synchronously with rotation of the engine. When the magnitude of acceleration required for the engine to perform exceeds a predetermined value, such as at sudden acceleration, in addition to accelerating fuel quantity increase according to the above control synchronous with the TDC signal, another accelerating fuel quantity increase is applied at the same time, which is executed in synchronism with a control signal having a certain constant pulse repetition period and being independent of the TDC signal (asynchronous accelerating fuel quantity increase control), so as to make up for a shortage in the increasing fuel amount obtained by the TDC signal-synchronized control at acceleration of the engine, thereby enhancing the output characteristic of the engine.

However, in such fuel supply control system, when the accelerator pedal is repeatedly stepped on many times immediately before or upon the start of the engine, an increase in the fuel quantity being supplied to the engine takes place due to the action of the system under the above asynchronous accelerating fuel quantity increase control, each time the accelerator pedal is stepped on, resulting in the supply of an excessive amount of fuel or an overrich mixture to the engine, thereby impeding smooth starting of the engine.

In order to eliminate the above disadvantage, it has been proposed to prohibit such accelerating fuel quantity increase while the rotational speed of the engine is below a cranking speed of the engine (Japanese Patent Publication No. 54-27490), and it has also been proposed to employ a circuit for preventing re-triggerring of a generator circuit for generating pulses of a control signal for increasing the fuel quantity at acceleration of the engine under a certain condition even when the engine is determined to be in an accelerating condition.

However, even with these proposed methods, it is difficult to achieve both satisfactory startability and satisfactory driveability at acceleration of the engine. That is, according to the former proposed method, no fuel increase is made at the start of the engine, which is disadvantageous in obtaining improved startability of the engine. Rather, the supply of a suitable amount of fuel to the engine will improve the startability of the engine at the start of the engine. On the other hand, according to the latter proposed method, if the re-triggering of the pulse generator circuit is prevented between generations of adjacent pulses of the TDC signal while simultaneously only one pulse of the fuel quantity increasing control signal, which is asychronous with the TDC signal, is generated between generations of adjacent pulses of the TDC signal, this will result in unsatisfactory driveability of the engine when the engine is accelerating in a region where the engine rotational speed is higher than the cranking speed, because, while such generation of only one pulse of the fuel quantity increasing signal asynchronous with the TDC signal will be sufficient to obtain satisfactory driveability when the engine is accelerating in a low speed region such as the cranking speed. Rather, generation of a plurality of such TDC signal-asynchronous fuel quantity increasing pulses to cause repeated fuel injections when the engine is accelerating in the above high speed region will result in that an air/fuel mixture can be supplied to the engine cylinders, with the fuel and the air uniformly mixed together, obtaining perfect combustion within the engine cylinders and consequently improving the driveability of the engine.

SUMMARY OF THE INVENTION

It is the object of the invention to provide a fuel supply control method for an internal combustion engine, which is capable of preventing the supply of an excessive amount of fuel to the engine when the accelerator pedal is repeatedly stepped on many times immediately before or upon the start of the engine, and which is also adapted to inject an additional amount of fuel into the engine which is appropriate to the operating condition of the engine, in a manner independent of generation of pulses of the TDC signal and so as to form a uniform air/fuel mixture, when the engine is accelerating, to thereby ensure stable starting of the engine as well as the accelerating driveability of the engine.

According to the invention, there is provided a method for electronically controlling the supply of fuel being injected into an internal combustion engine through a fuel injection device, which is characterized by comprising the following steps: (1) monitoring generation of pulses of an engine position signal indicative of a predetermined crank angle of the engine; (2) determining whether or not the ignition switch of the engine is in a closed position; (3) detecting the value of at least one predetermined control parameter of the engine; (4) determining whether or not the detected value of the at least one predetermined control parameter shows a value indicative of a predetermined accelerating condition of the engine; (5) when it is determined in the step (4) that the detected value of the at least one predetermined control value shows the above value, actuating the fuel injection device to inject fuel into the engine consecutively a predetermined number of times in synchronism with generation of pulses of a control signal having a predetermined constant pulse repetition period and generated independently of rotation of the engine, immediately after either generation of a pulse of the above engine position signal or closing of the ignition switch has been detected; and (6) after completion of the above fuel injections, suspending fuel injection until a subsequent pulse of the above engine position signal is generated for the first time after the completion of the fuel injections.

Preferably, even if it is detected that the value of the at least one predetermined control parameter is changed to show a value indicative of a normal operating condition of the engine other than the predetermined accelerating condition and a decelerating condition of the engine before completion of the above consecutive fuel injections in the step (5), the same consecutive fuel injections are continued until the above predetermined number of times of fuel injections are completed. The injection quantity of fuel per one time is set in dependence on the the value of the above-mentioned predetermined control parameter, preferably, rate of change of the valve opening of a throttle valve arranged in an intake passage of the engine. When the rate of change of the throttle valve opening is larger than a first predetermined value while the valve opening is increasing, it is determined that the engine is in the above predetermined accelerating condition, whereas if the rate of change is smaller than the above first predetermined value while the same rate is smaller than a second predetermined value while the valve opening is decreasing, it is determined that the engine is in the above normal operating condition.

Also preferably, the value of the above predetermined number of times of consecutive fuel injections is set in dependence upon the temperature of the engine, to thereby further ensure positive starting of the engine. Further, preferably, it is determined whether or not the engine is in a predetermined operating condition requiring cutting off the fuel supply, as well as whether or not the engine is in an operating condition requiring interruption of the fuel cut. Before a predetermined period of time elapses from the interruption of the fuel cut, the value of the predetermined number of times of consecutive fuel injections is set to a value different than that after the same period of time has elapsed, preferably, the former value being set to a fewer value than the latter value, thereby enhancing the accelerability of the engine in accordance with the operating conditions of the engine.

The above and other objects, features and advantages of the invention will be more apparent from the ensuing detailed description taken in conjunction with the accompanying drawings.

DETAILED DESCRIPTION

The present invention will now be described in detail with reference to the drawings.

Figure 1:
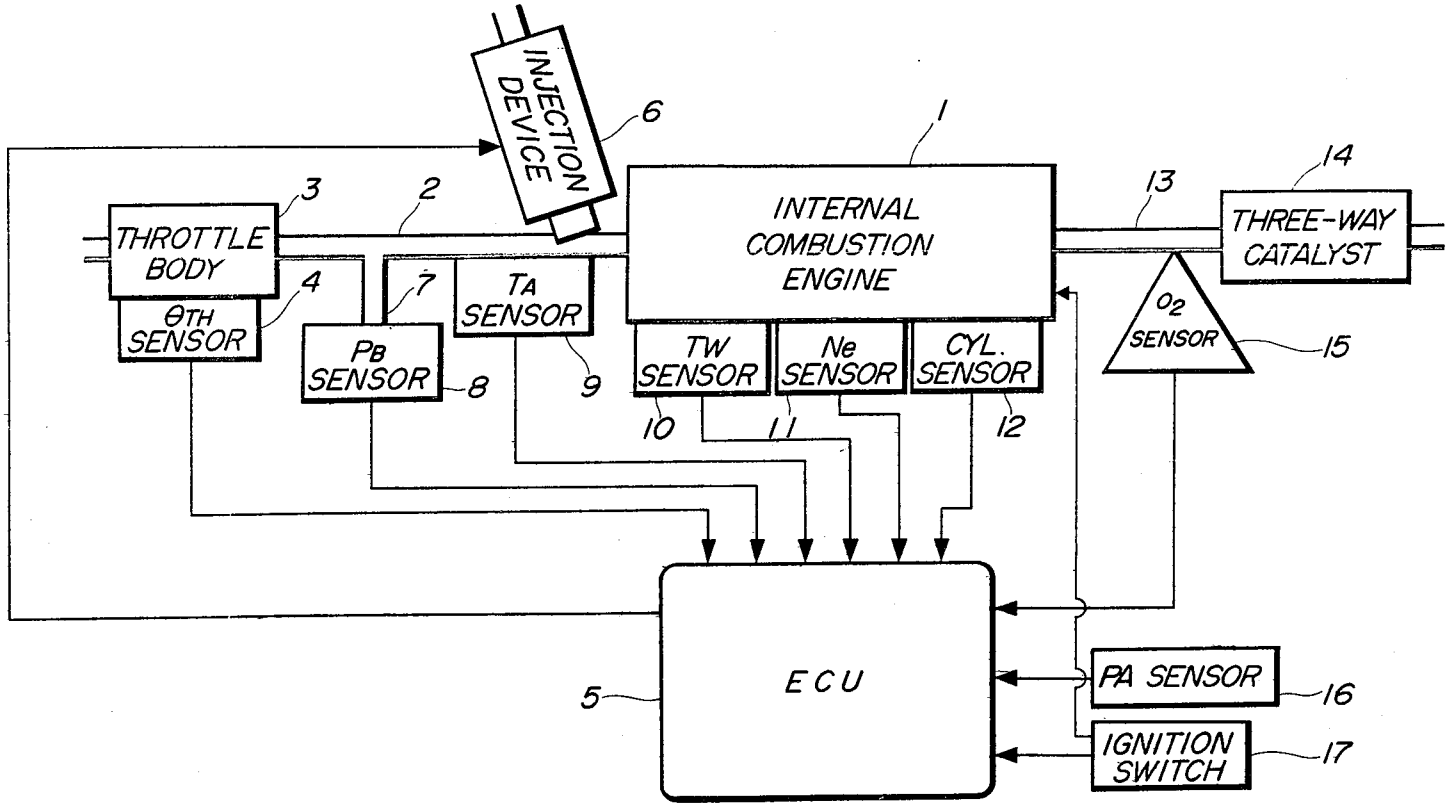
FIG. 1 is a block diagram illustrating the whole arrangement of a fuel supply control system to which is applicable the method according to the present invention.

Referring first to FIG. 1, there is illustrated the whole arrangement of a fuel supply control system for internal combustion engines, to which the method according to the invention is applicable. Reference numeral 1 designates an internal combustion engine which may be a four-cylinder type, for instance. An intake pipe 2 is connected to the engine 1, in which is arranged a throttle valve 3, which in turn is coupled to a throttle valve opening ($\theta$TH) sensor 4 for detecting its valve opening and converting same into an electrical signal which is supplied to an electronic control unit (hereinafter called "ECU") 5.

Fuel injection valves 6 are arranged in the intake pipe 2 at a location between the engine 1 and the throttle valve 3, which correspond in number to the engine cylinders and are each arranged at a location slightly upstream of an intake valve, not shown, of a corresponding engine cylinder. These injection valves are connected to a fuel pump, not shown, and also electrically connected to the ECU 5 in a manner having their valve opening periods or fuel injection quantities controlled by signals supplied from the ECU 5.

On the other hand, an absolute pressure (PB) sensor 8 communicates through a conduit 7 with the interior of the intake pipe at a location immediately downstream of the throttle valve 3. The absolute pressure sensor 8 is adapted to detect absolute pressure in the intake pipe 2 and applies an electrical signal indicative of detected absolute pressure to the ECU 5. An intake air temperature (TA) sensor 9 is arranged in the intake pipe 2 at a location downstream of the absolute pressure sensor 8 and also electrically connected to the ECU 5 for supplying thereto an electrical signal indicative of detected intake air temperature.

An engine temperature (TW) sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rotational angle position (Ne) sensor 11 and a cylinder-discriminating sensor 12 are arranged in facing relation to a camshaft, not shown, of the engine 1 or a crankshaft of same, not shown. The former 11 is adapted to generate one pulse at a particular crank angle of the engine each time the engine crankshaft rotates through 180 degrees, i.e., upon generation of each pulse of a top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure (PA) and an ignition switch 17 for actuating the engine starter, not shown, of the engine 1, respectively, for supplying the ECU 5 with an electrical signal indicative of detected atmospheric pressure and an electrical signal indicative of the on-off positions of the ignition switch.

The ECU 5 operates in response to various engine operation parameter signals as stated above, to calculate the fuel injection period of the fuel injection valves 6, in accordance with the determined operating conditions of the engine, and supplies corresponding driving signals to the fuel injection valves 6.

Figure 2:
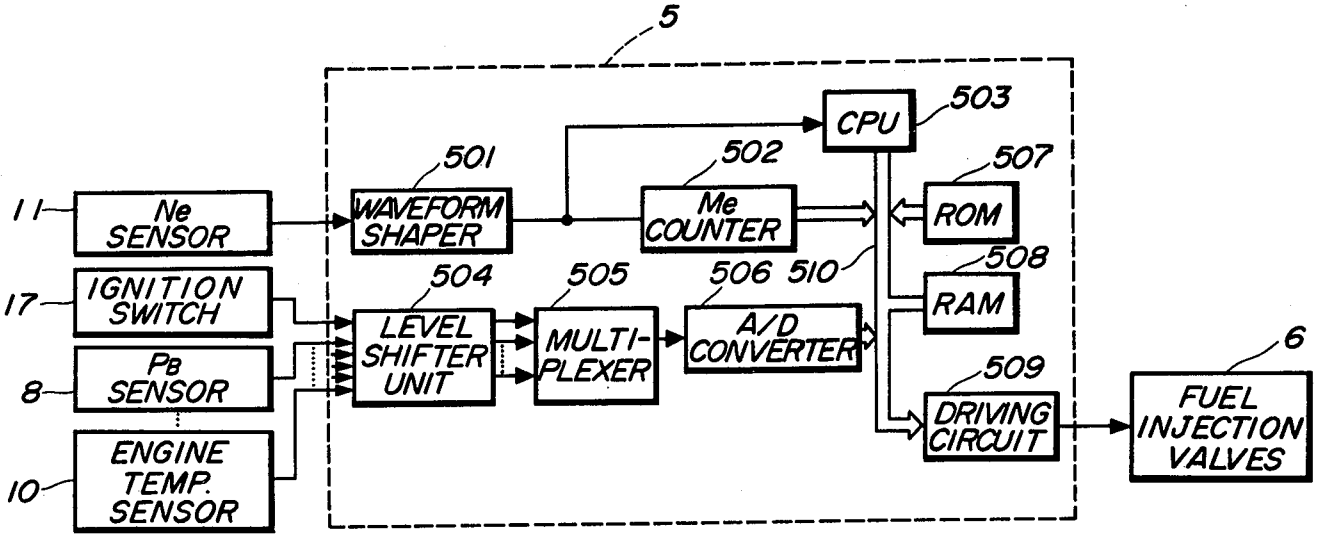
FIG. 2 is a circuit diagram showing an electrical circuit within the electronic control unit (ECU) in FIG. 1.

FIG. 2 shows a circuit configuration within the ECU 5 in FIG. 1. An output signal from the engine rotational angle position sensor 11 is applied to a waveform shaper 501, wherein it has its pulse waveform shaped, and supplied to a central processing unit (hereinafter called "CPU") 503, as the TDC signal, as well as to an Me value counter 502. The Me value counter 502 counts the interval of time between a preceding pulse of the TDC signal generated at a predetermined crank angle of the engine and a present pulse of the same signal generated at the same crank angle, inputted thereto from the engine rotational angle position sensor 11, and therefore its counted value Me corresponds to the reciprocal of the actual engine rpm Ne. The Me value counter 502 supplies the counted value Me to the CPU 503 via a data bus 510.

The respective output signals from the intake pipe absolute pressure (PB) sensor 8, the engine coolant temperature sensor 10, the ignition switch 17, etc. have their voltage levels successively shifted to a predetermined voltage level by a level shifter unit 504 and applied to an analog-to-digital converter 506 through a multiplexer 505. The analog-to-digital converter 506 successively converts into digital signals analog output voltages from the aforementioned various sensors, and the resulting digital signals are supplied to the CPU 503 via the data bus 510.

Further connected to the CPU 503 via the data bus 510 are a read-only memory (hereinafter called "ROM") 507, a random access memory (hereinafter called "RAM") 508 and a driving circuit 509. The RAM 508 temporarily stores various calculated values from the CPU 503, while the ROM 507 stores a control program executed within the CPU 503 as well as various tables and maps, various correction coefficients and constants, etc. The CPU 503 executes the control program stored in the ROM 507 to calculate the fuel injection period for the fuel injection valves 6 in response to the various engine operation parameter signals, and supplies the calculated value of fuel injection period to the driving circuit 509 through the data bus 510. The driving circuit 509 supplies driving signals corresponding to the above calculated value to the fuel injection valves 6 to drive same.

Next, the fuel quantity control operation of the fuel supply control system arranged as above will now be described in detail with reference to FIGS. 1 and 2 referred to hereinabove, as well as FIG. 3 through FIG. 12.

Figure 3:
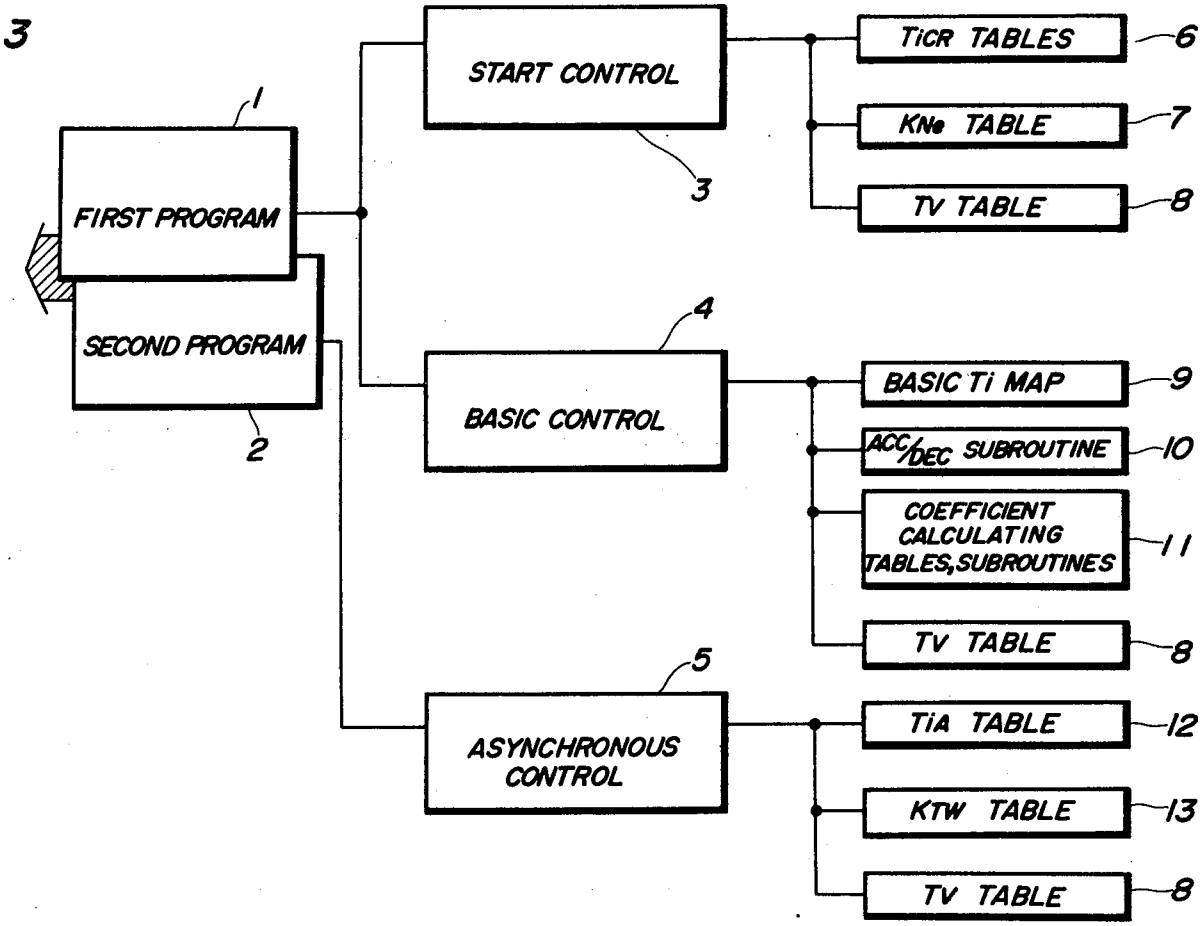
FIG. 3 is a block diagram illustrating a program for control of the valve opening period of the fuel injection valves, which are operated by the ECU in FIG. 1.

Referring first to FIG. 3, there is illustrated a block diagram showing the whole program for control of the valve opening period of the fuel injection valves 6, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal, i.e. rotation of the engine.

In the start control subroutine 3, the valve opening period is determined by the following basic equations:

$$TOUT = TiCR \times KNe + TV \quad (1)$$

where TiCR represents a basic value of the valve opening period for the fuel injection valves 6, which is determined from a TiCR table 6, KNe represents a correction coefficient applicable at the start of the engine, which is variable as a function of engine rpm Ne and determined from a KNe table 7, and TV represents a correction value for increasing and decreasing the valve opening period in response to changes in the output voltage of the supply power battery, which is determined from a TV table 8.

The basic equation for determining the value of TOUT applicable to the basic control subroutine 4 are as follows:

$$TOUT=(Ti-TDEC)\times(KTA\times KTW\times KAFC\times KPA\times KAST\times KWOT\times KO_2\times KLS)+TACC\times(KTA\times KTWT\times KAFC)+TV \quad (2)$$

where Ti represents a basic value of the valve opening period for the fuel injeciton valves 6, and is determined from a basic Ti map 9, TDEC, TACC represent correction values applicable, respectively, at engine deceleration and at engine acceleration and are determined by acceleration and deceleration subroutines 10, and KTA, KTW, etc. represent correction coefficients which are determined by their respective tables and/or subroutines 11. KTA is an intake air temperature-dependent correction coefficient and is determined from a table as a function of actual intake air temperature, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ concentration-responsive feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometeric" and means a stoichiometric or theoretical air/fuel ratio of the mixture.

On the other hand, the valve opening period TMA for the fuel injection valves 6 which is applicable in asynchronism with the TDC signal is determined by the following equation:

$$TMA=TiA\times KTWT\times KAST+TV \quad (3)$$

where TiA represents a TDC signal-asynchronous fuel increasing basic value applicable at engine acceleration and in asynchronism with the TDC signal. This TiA value is determined from a TiA table 12. KTWT is defined as a fuel increasing coefficient applicable at and after TDC signal-synchronous accelerating control as well as at TDC signal-asynchronous accelerating control, and is calculated from a value of the aforementioned water temperature-dependent fuel increasing coefficient KTW obtained from the table 13.

Figure 4:
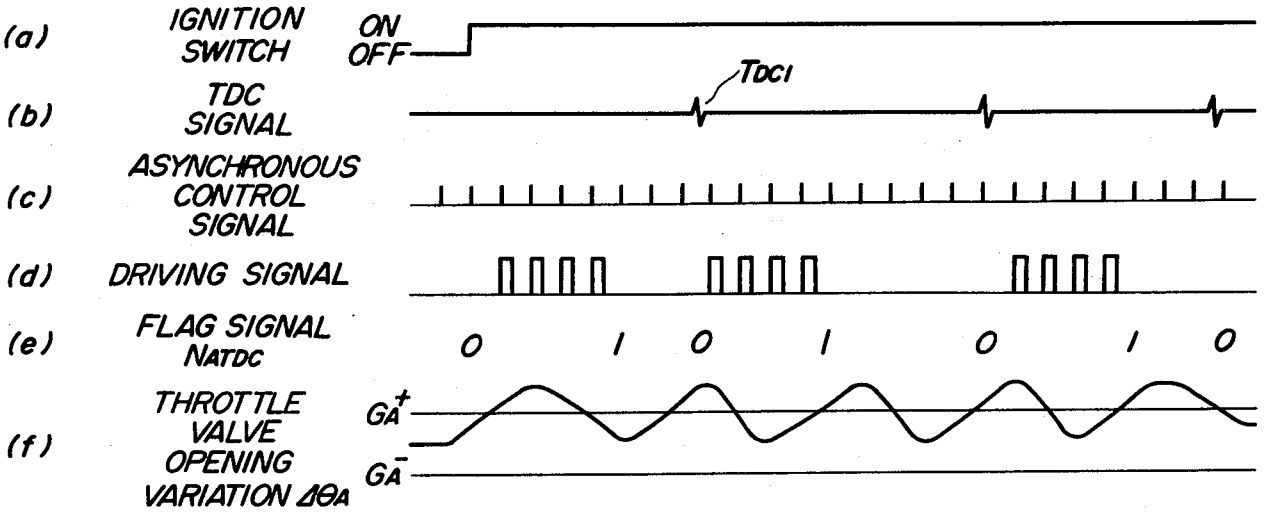
FIG. 4 is a timing chart showing an embodiment of fuel injection control executed at the start of the engine, according to the invention.

Among the above described methods of the valve opening period control, the engine rotation-asynchronous accelerating control according to the invention will now be described in detail with reference to FIG. 4. First, it is determined whether or not a rate of change $\Delta\theta A$ of the valve opening of the throttle valve 3, i.e. an amount of change in the throttle valve opening with respect to the progress of time is larger than a predetermined acceleration determining value GA+. That is, at the start of the engine, when it is determined that the ignition switch 17 in FIG. 2 has become turned on or closed ((a) in FIG. 4), and it is also determined, in synchronism with generation of each pulse of an asynchrosnous control signal having a constant pulse repetition period and generated independently of rotation of the engine, whether or not the difference or variation $\Delta\theta A$ between a value $\theta An-1$ of the throttle valve opening detected in the present loop and a value $\theta An-1$ of same detected in the preceding loop, which values are read into the ECU 5 in synchronism with generation of each pulse of the above asynchronous control signal, is larger than the predetermined acceleration determining value GA+. If the difference or variation $\Delta\theta A$ is found to be larger than the predetermined acceleration determining value GA+ ((f) in FIG. 4), it is judged that the engine is in an accelerating condition, a predetermined number of or at least two fuel increasing pulses (four in the illustrated example) are each applied as driving signals to each of the fuel injection valves 6 each time a pulse of the above asynchronous control signal is generated ((d) in FIG. 4). After the above predetermined number of fuel increasing pulses for driving the fuel injection valves 6 have been outputted, further outputting of such pulses is prohibited until a first pulse TDC1 of the TDC signal ((b) in FIG. 4) is generated from the completion of outputting of the fuel increasing pulses ((d) in FIG. 4). Thereafter, in the same manner as above, when it is determined that the throttle valve opening variation $\Delta\theta A$ is larger than the predetermined acceleration determining value GA+ between each subsequent pulse of the TDC signal and the next pulse of same, the predetermined number of fuel increasing pulses alone are consecutively outputted between the adjacent pulses of the TDC signal. By controlling the fuel quantity being supplied to the engine in the above manner, it is possible to prevent the supply of an excessive amount of fuel to the engine in the event of an accelerator pedal coupled to the throttle valve being repeatedly stepped on many times immediately before or upon the start of the engine, thereby improving the startability of the engine.

Figure 5:
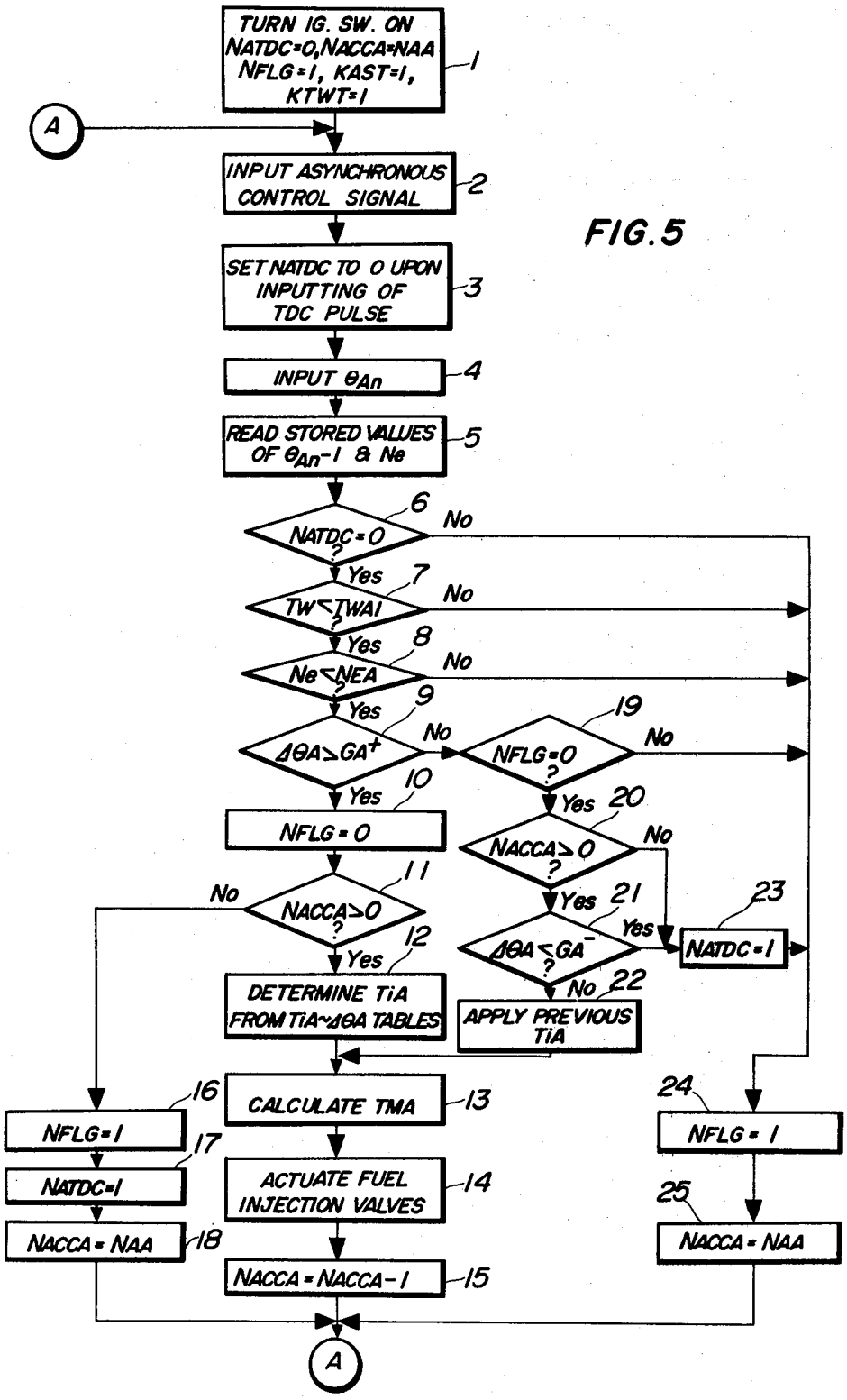
FIG. 5 is a flow chart showing a subroutine of the engine rotation-asynchronous accelerating control according to the invention.
Figure 7:
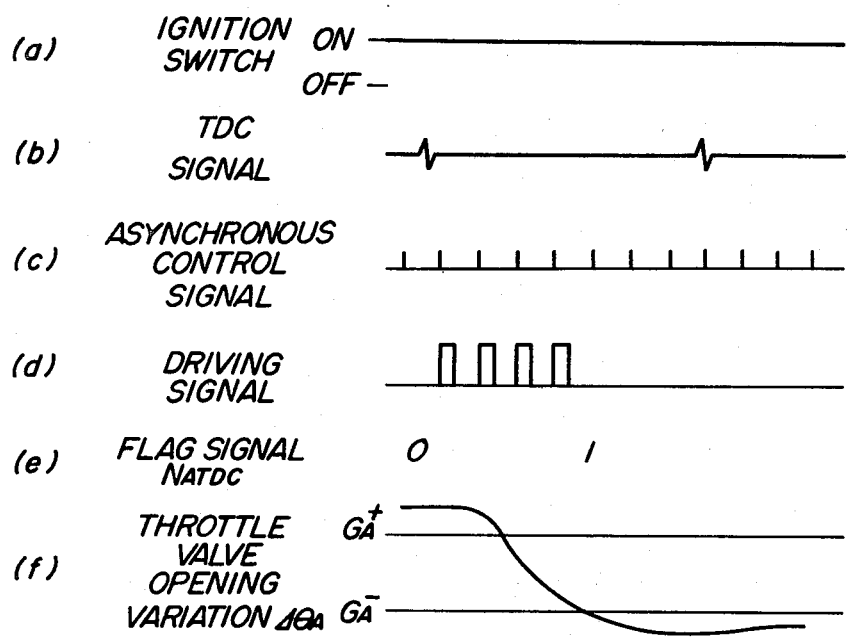
FIG. 7 is a timing chart showing an embodiment of fuel injection control executed at normal acceleration of the engine.
Figure 6:
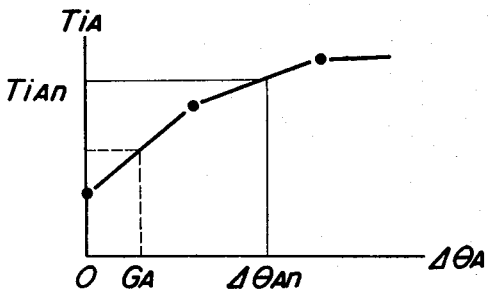
FIG. 6 is a graph showing a table of the relationship between the rate of change $\Delta\theta A$ in the throttle valve opening and a basic value of fuel increment TiA according to the engine rotation-asynchronous accelerating control.

FIG. 5 shows a flow chart of a subroutine for performing the engine rotation-asynchronous accelerating control (hereinafter called "asynchronous accelerating control") according to the invention. At the step 1, a transition in the position of the ignition switch 17 in FIG. 2 is detected from the off position (open position) to the on position (closed position), and at the same time, the value of a flag signal NATDC is set to 0, and a second flag signal NFLG to 1, respectively. These flag signals NATDC, NFLG indicate whether or not the engine is in a condition wherein the asynchronous accelerating control should be effected. The signal NATDC is set to 0 when the ignition switch 17 is turned on, as well as each time a pulse of the TDC signal is inputted to the ECU 5, to indicate that pulses of the driving signal for the fuel injection valves can be outputted according to the asynchronous accelerating control. On the other hand, it is set to 1 upon inputting of a pulse of the asynchronous control signal immediately after the aforementioned predetermined number of fuel increasing pulses or pulses of the driving signal have been outputted, to prohibit further outputting of pulses of the driving signal ((e) in FIG. 4). The flag signal NFLG is set to 0 while the engine is in a predetermined condition wherein the asynchronous accelerating control should be effected, and set to 1 while the engine is in other conditions. Further, when the ignition switch 17 is turned on, the number of pulses NACCA indicative of the number of pulses of the driving signal that remain to be outputted is set to an initial value (e.g. 4), and simultaneously the values of the correction coefficients KAST, KTWT are both set to 1. Then, pulses of the asynchronous control signal are inputted to a corresponding counter in the ECU 5, at the step 2. The pulse separation of this asynchronous control signal is set to a value within a range of 10–50 ms. Then, each time a pulse of the TDC signal is inputted to the ECU 5, the value of the above flag signal NATDC is set to 0, at the step 3. Further, each time a pulse of the asynchronous control signal is inputted to the counter, the value of the throttle valve opening $\theta$An is read into a corresponding register in the ECU 5, at the step 4. A value $\theta$An−1of the throttle valve opening and a value of the engine rpm Ne detected upon inputting of the preceding pulse of the asynchronous control pulse and stored in the above register are read from the respective registers, at the step 5. Then, whether or not the aforementioned flag signal NATDC assumes a value of 0 is determined at the step 6. If the answer is yes, it is determined at the step 7 whether or not the engine cooling water temperature TW is lower than a predetermined value TWA1 (e.g. 70° C.). When the temperature of the engine is high, good combustion takes place within the engine cylinders, permitting stable operation of the engine even without increase of the fuel supply quantity to the engine, and also permitting application of a fuel increment TACC according to the TDC signal-synchronized control alone to suffice at acceleration of the engine, even at sudden acceleration. Therefore, if the engine cooling water temperature TW is above the predetermined value TWA1, the asynchronous accelerating control is not effected according to the invention. If the engine water temperature TW is found to be lower than the predetermined value TWA1 at the step 7, it is then determined at the step 8 whether or not the engine speed Ne is lower than a predetermined value of rpm NEA (e.g. 2,800 rpm) for determination of fulfillment of the asynchronous accelerating control condition. As the engine speed Ne becomes higher, the pulse separation or pulse interval of the TDC signal becomes shorter, and accordingly the aforementioned acceleration fuel increment TACC alone according to the synchronous control alone will suffice to obtain satisfactory responsiveness of fuel increasing control to acceleration of the engine. Therefore, when the engine speed Ne exceeds the above predetermined value of rpm NEA, the fuel increasing action according to the asynchronous accelerating control is prohibited. If any of the answers to the questions at the above steps 6 to 8 is negative, execution of the asynchronous accelerating control is prohibited. That is, the value of the flag signal NFLG is set to 1 at the step 24, and the value of the pulse number NACCA is set to the initial value NAA at the step 25. If at the step 8 it is determined that the engine speed Ne is lower than the predetermined value of rpm NEA, it is determined at the step 9 whether or not the difference or variation $\Delta\theta$A between the value $\theta$An of the throttle valve opening in the present loop and the value $\theta$An−1 of same in the preceding loop, read at the step 4 is larger than the aforementioned predetermined value GA+ (e.g. 20°/sec). If the answer is affirmative, the value of the flag signal NFLG is set to 0 at the step 10 and it is determined at the step 11 whether or not the stored value of the pulse number NACCA is larger than 0. If the answer is yes, a basic value TiA of the asynchronous acceleration fuel increment is determined from a table, at the step 12. FIG. 6 shows an example of such table plotting the relationship between the amount of change $\Delta\theta$A and the basic value TiA of the asynchronous acceleration fuel increment. As shown in this table, the basic value TiA is increased up to a constant value with an increase in the throttle valve opening variation $\Delta\theta$A or the magnitude of acceleration which the engine is to perform. Then, the valve opening period TMA of the fuel injection valves 6 is calculated from the aforegiven equation (3), at the step 13. In the equation (3), the values of the terms KAST, KTWT and TV are updated each time a pulse of the TDC signal is inputted to the ECU, as previously noted. At the step 14, the fuel injection valves 6 is actuated to open for the valve opening period TMA calculated at the step 13. Each time the step 14 is executed, 1 is subtracted from the stored value of the pulse number NACCA, at the step 15. When the answer to the question at the step 11 is negative, the values of the flag signals NATDC, NFLG are both set to 1, at the steps 16 and 17, and at the same time, the stored value of the pulse number NACCA is set to the initial value NAA, at the step 18. On the other hand, if the answer to the question at the step 9 is negative, that is, if the throttle valve opening variation $\Delta\theta$A is determined to be smaller than the predetermined value GA+, it is then determined at the step 19 whether or not the value of the flag signal NFLG indicative of fulfillment of the predetermined asynchronous accelerating control condition is 0. If the answer is yes, it is further determined at the step 20 whether or not the stored value of the pulse number NACCA in the present loop is larger than 0, and also at the step 21 whether or not the throttle valve opening variation $\Delta\theta$A is smaller than a predetermined negative value GA− for determining fulfillment of a decelerating condition of the engine. If the answer to the question of the step 21 is no, that is, if the variation $\Delta\theta$A is larger than the predetermined negative value GA−, a basic value TiA of the asynchronous accelerating control determined in the preceding loop is applied for calculation of the valve opening period TMA, at the steps 22 and 13, to carry out fuel injection according to the asynchronous accelerating control in the manner described above (step 14), and simultaneously 1 is subtracted from the stored value of the pulse number NACCA at the step 15. If the answer to the question at the step 20 is negative and at the same time the answer to the question at the step 21 is affirmative, the values of the flag signals NATDC, NFLG are both set to 1, at the steps 23 and 24, accompanied by setting the stored value of the pulse number NACCA to the initial value NAA at the step 25. If the accelerating fuel increase is effected only when the throttle valve opening variation $\Delta\theta$A is larger than the predetermined positive value GA+, the fuel increasing action can be interrupted before fuel injections corresponding in number to the predetermined number of fuel increasing pulses are finished, in the latter half of an accelerating action of the engine wherein the rate of change of the throttle valve opening decreases while the valve opening is increasing or the variation $\Delta\theta$A becomes zero or negative, resulting in deterioration of the driveability of the engine. To eliminate this disadvantage, according to the invention, as stated above, even if the throttle valve opening variation $\Delta\theta$A becomes equal to the predetermined value GA+ or smaller than same, the asynchronous fuel increasing action is continued so far as the variation $\Delta\theta$A remains larger than the predetermined negative value GA−, that is, except when the driver wants to decelerate the engine, thereby enabling continued execution of an accelerating fuel injections corresponding to the predetermined number of driving pulses to obtain a required increase in the engine output as well as improve the driveability in sudden snapping of the engine or stepping on the accelerator pedal to a fully opened position of the throttle valve. For example, referring to FIG. 7, even when the throttle valve opening variation $\Delta\theta A$ decreases from a region exceeding the predetermined value GA+ to a region below the same value, pulses of the driving signal for the fuel injection valves 6 are consecutively outputted up to the predetermined number of 4. Also in the starting control as shown in FIG. 4, the same manner of outputting driving pulses is employed.

Figure 8:
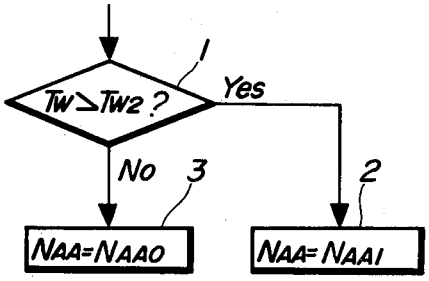
FIG. 8 is a flow chart showing a subroutine for determining the number of fuel increasing pulses indicative of the number of times of consecutive fuel injections according to the engine rotation-asynchronous accelerating control, as a function of the engine cooling water temperature TW.

Further, the lower the engine temperature, the larger the fuel increasing quantity required for starting of the engine or sudden acceleration of same becomes. In view of this, according to the invention, the initial value NAA of the asynchronous acceleration fuel increasing pulses is set as a function of the engine temperature, so as to carry out accelerating control in a manner more suited for operating conditions of the engine, ensuring further improvement of the driveability and positive starting of the engine. FIG. 8 shows an exemplary manner of setting the initial value NAA in two steps in dependence on the engine temperature TW. It is determined at the step 1 whether or not the engine cooling water temperature TW is higher than a predetermined value $TW_2$ (e.g. 30° C.). If the answer is yes, the initial value NAA is set to a lower value NAA1 (e.g. 4) at the step 2, while if the answer is no, the same value NAA is set to a higher value NAA0 (e.g. 10), at the step 3. The above predetermined temperature value TW2 is set at a value within a range of −30° C. to +70° C. Alternatively of the manner of setting the value NAA stepwise, i.e. to a plurality of different values, the value NAA may be varied steplessly with a change in the engine cooling water temperature TW.

Figure 9:
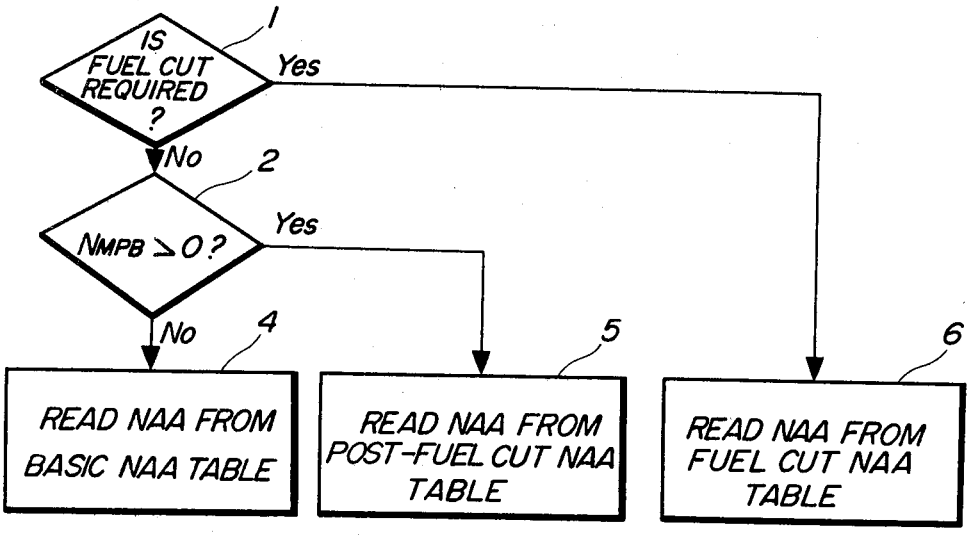
FIG. 9 is a flow chart showing a subroutine for determining the number of fuel increasing pulses NAA executed at acceleration of the engine after termination of a fuel cut operation.
Figure 10:
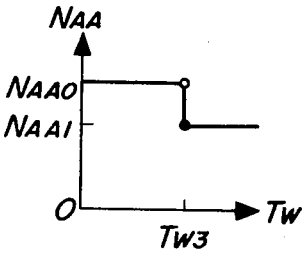
FIG. 10 is a graph showing a table of the relationship between the number of fuel increasing pulses NAA applied at normal acceleration of the engine after the lapse of a predetermined period of time from generation of a first TDC signal pulse immediately after termination of a fuel cut operation and the engine cooling water temperature TW.
Figure 11:
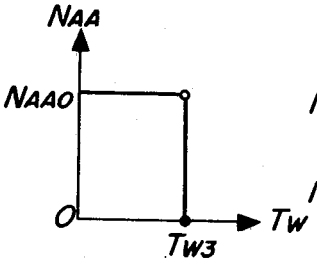
FIG. 11 is a graph showing a table of the relationship between the number of fuel increasing pulses NAA applied at acceleration before the lapse of the predetermined period of time from generation of a first TDC signal pulse immediately after termination of a fuel cut operation and the engine cooling water temperature TW.

Further, according to the invention, in addition to the above described manners of control, the initial value NAA of pulses of the above fuel increasing signal is set to different values depending upon whether the engine is in a fuel cut effecting condition or in a condition immediately after a fuel cut operation. FIG. 9 shows an example of the manner of setting the initial value NAA depending upon the fuel cut operation or post-fuel cut operation of the engine. First, it is determined at the step 1 whether or not the engine is in a fuel cut effecting condition, each time a pulse of the TDC signal is inputted to the ECU 5. If the answer is no, that is, if the engine is not in the fuel cut effecting condition, a further determination is made as to whether or not a predetermined value NMPB which is set to a value equal to the number of the engine cylinders (e.g. 4) is larger than 0, at the step 2. The above predetermined value NMPB is reduced by 1 each time a pulse of the TDC signal is inputted to the ECU 5, and is reduced to 0 when all the cylinders of the engine are each supplied with one batch of fuel after termination of a fuel cut operation. When the predetermined value NMPB is determined to be 0 at the step 2, a value of the initial pulse number NAA is determined from a basic NAA table, which corresponds to the actual engine cooling water temperature TW, at the step 4, and when it is determined that the engine is in an accelerating condition, between the time of generation of a present pulse of the TDC signal and the time of generation of the next pulse of same, fuel injections according to the asynchronous accelerating control are effected a number of times equal to the initial value NAA thus determined. FIG. 10 shows an example of the above basic NAA table. According to this table, when the engine water temperature TW is lower than a predetermined value TW3 (e.g. 20° C.), the initial pulse number NAA is set to a predetermined value NAA0 (e.g. 10), while when the water temperature TW is higher than the predetermined value TW3, the initial value NAA is set to another predetermined value NAA1 (e.g. 4). The above predetermined temperature TW3 is set at a value within a range of −30° C. to +70° C. On the other hand, if the answer to the question of the step 2 is affirmative, that is, before four pulses of the TDC signal are inputted to the ECU 5 after termination of a fuel cut operation, a value of the initial value NAA corresponding to the engine water temperature TW is now determined from a post-fuel cut NAA table. FIG. 11 shows an example of the post-fuel cut NAA table. According to the table, the intial value NAA is set to the aforementioned predetermined value NAA0 (e.g. 10) when the engine water temperature TW is lower than the predetermined value TW3, and set to 0 when the temperature TW is higher than the latter. The reason for setting the intial value NAA to 0 when the engine water temperature TW is above the predetermined value TW3 to prohibit the asynchronous accelerating control is that immediately after termination of a fuel cut operation, the aforementioned after-fuel cut fuel increasing coefficient KAFC, whose value is determined by a predetermined subroutine, is applied for the TDC signal-synchronous basic control for a period of time corresponding to the predetermined value NMPB for prevention of engine stall, etc., but if on such occasion a further fuel increase according to the asynchronous accelerating control is applied at the same time, the resultant fuel injection quantity will be undesirably excessive. Alternatively of completely prohibiting the fuel increase according to the asynchronous accelerating control immediately after termination of a fuel cut operation as described above, the same control may be applied on such an occasion to increase the fuel supply quantity by a slight amount so as to compensate for variations in the operating characteristics of the engine.

Figure 12:
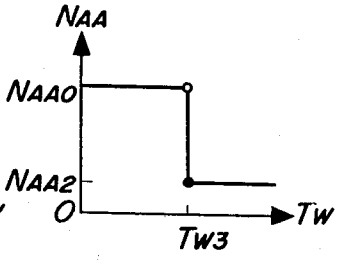
FIG. 12 is a graph showing a table of the relationship between the number of fuel increasing pulses NAA applied at acceleration before generation of a first TDC signal pulse from the time of detection of an operating condition of the engine requiring interruption of a fuel cut operation and the engine cooling water temperature TW.

On the other hand, when the engine cooling water temperature TW is lower than the predetermined value TW3, such as in cold weather, wherein the engine requires rather a great amount of fuel such as in acceleration, the initial value NAA of fuel increasing pulses is set to the predetermined value NAA0 (e.g. 10). Reverting now to the aforementioned step 1 of FIG. 9, if the engine is determined to be in the fuel cut effecting condition, the step 6 is then executed to determine a value of the initial value NAA corresponding to the engine water temperature TW, from a fuel cut NAA table. FIG. 12 shows an example of this fuel cut NAA table, the initial value NAA is set to the predetermined value NAA0 (e.g. 10) when the engine water temperature TW is below the predetermined value TW3, and set to a predetermined value NAA2 (e.g. 2) when the engine water temperature TW is above the predetermined value TW3.

What is claimed is:

1. A method for electronically controlling the supply of fuel being injected into an internal combustion engine having an ignition switch, through a fuel injection device, the method comprising the steps of: (1) monitoring generation of pulses of an engine position signal indicative of a predetermined crank angle of said engine; (2)

determining whether or not said ignition switch of said engine is in a closed position; (3) detecting the value of at least one predetermined control parameter of said engine; (4) determining whether or not said detected value of said at least one predetermined control parameter shows a value indicative of a predetermined accelerating condition of said engine; (5) when it is determined in said step (4) that said detected value of said at least one predetermined control value shows said value indicative of said predetermined accelerating condition of said engine, actuating said fuel injection device to inject fuel into said engine consecutively a predetermined number of times in synchronism with generation of pulses of a control signal having a predetermined constant pulse repetition period and generated independently of rotation of said engine, immediately after either generation of a pulse of said engine position signal or closing of said ignition switch has been detected; and (6) after completion of said consecutive fuel injections, suspending fuel injection until a subsequent pulse of said engine position signal is generated for the first time after the completion of said fuel injections.

2. A method as claimed in claim 1, wherein said engine includes an intake passage and a throttle valve arranged in said intake passage, said at least one predetermined control parameter including the amount of change of the valve opening of said throttle valve with respect to the progress of time.

3. A method as claimed in claim 2, including the step of determining whether or not said detected value of said at least one predetermined control parameter shows a second value indicative of a normal operating condition of said engine other than said predetermined accelerating condition and a decelerating condition thereof, and wherein said consecutive fuel injections in said step (5) are continued until said predetermined number of times are reached even when it is determined that said detected value of said at least one predetermined control parameter changes to said second value before said predetermined number of times of consecutive fuel injections are completed.

4. A method as claimed in claim 3, wherein said engine is determined to be in said normal operating condition when the amount of change of the valve opening of said throttle valve with respect to the progress of time assumes a value smaller than a first predetermined value while the valve opening is increasing and smaller than a second predetermined value while the valve opening is decreasing.

5. A method as claimed in claim 2, wherein said engine is determined to be in said predetermined accelerating condition when the amount of change of the valve opening of said throttle valve with respect to the progress of time is larger than a predetermined value.

6. A method as claimed in claim 1, including the step of setting a quantity of fuel being injected per each of said predetermined number of times in said step (5) in dependence on the magnitude of acceleration required for said engine to perform, which is determined by said detected value of said at least one predetermined control parameter.

7. A method as claimed in claim 1, including the step of setting the value of said predetermined number of times of consecutive fuel injections in said step (5) in dependence on the temperature of said engine.

8. A method as claimed in claim 7, wherein the value of said predetermined number of times of consecutive fuel injections in said step (5) is increased as the temperature of said engine decreases, when the temperature of said engine is lower than a predetermined value.

9. A method as claimed in any of claims 1, 2, 5–8, including the steps of determining whether or not said engine is in a predetermined condition requiring cutting off the fuel supply to said engine and also whether or not said engine is in an operating condition requiring interruption of said cutting-off of the fuel supply, determining whether or not a predetermined period of time has elapsed from the time said engine is determined to be in said operating condition requiring interruption of said cutting-off of the fuel supply, and setting the value of said predetermined number of times of consecutive fuel injections in said step (5) to different values between before the lapse of said predetermined period of time and after the lapse thereof.

10. A method as claimed in claim 9, wherein before the lapse of said predetermined period of time the value of said predetermined number of times of consecutive fuel injections in said step (5) is set to a value fewer than a value after the lapse of said predetermined period of time.

11. A method as claimed in claim 1, including the step of prohibiting said consecutive fuel injections in said step (5) when the temperature of said engine is higher than a predetermined value.

12. A method as claimed in claim 1, including the step of prohibiting said consecutive fuel injections in said step (5) when the rotational speed of said engine is higher than a predetermined value.

13. A method as claimed in any of claims 1, 2, 5–8, 11 and 12, including the steps of setting a quantity of fuel being injected into said engine in dependence on operating conditions of said engine, each time a pulse of said engine position signal in said step (1) is generated, and actuating said fuel injection device to inject said quantity of fuel thus set into said engine in synchronism with generation of pulses of said engine position signal.

* * * * *